United States Patent [19]

Scheller

[11] Patent Number: 5,035,421

[45] Date of Patent: Jul. 30, 1991

[54] THERAPEUTIC DEVICE

[76] Inventor: Dennis M. Scheller, 7121 Riverview Ter., Fridley, Minn. 55432

[21] Appl. No.: 614,925

[22] Filed: Nov. 16, 1990

[51] Int. Cl.[5] ..... A63B 23/04; A63B 23/08; A63B 23/10

[52] U.S. Cl. ..... 272/96; 272/70; 128/25 B

[58] Field of Search ..... 272/70, 96, 97, 146, 272/135, 136, 138, 139, 142; 128/25 R, 25 B

[56] References Cited

U.S. PATENT DOCUMENTS

| | | | |
|---|---|---|---|
| 2,206,902 | 7/1940 | Kost | 272/96 |
| 3,007,280 | 11/1961 | Berberch | 272/96 |
| 4,111,416 | 9/1978 | Jinotti | 272/96 |
| 4,306,714 | 12/1981 | Loomis et al. | 272/96 |
| 4,371,160 | 2/1983 | Shoultz | 272/96 |
| 4,573,678 | 3/1986 | Lamb et al. | 272/96 |
| 4,605,220 | 8/1986 | Troxel | 272/96 |
| 4,733,859 | 3/1988 | Kock et al. | 272/96 |

FOREIGN PATENT DOCUMENTS

| | | | |
|---|---|---|---|
| 1378841 | 3/1988 | U.S.S.R. | 128/25 B |

*Primary Examiner*—Richard J. Apley
*Assistant Examiner*—Karen G. Horowitz
*Attorney, Agent, or Firm*—Lawrence M. Nawrocki

[57] ABSTRACT

An exercise apparatus comprising a foot receiving plate, a pivoting support and a base. The foot receiving plate includes a strap for the user's foot, a ball joint adjacent and on the bottom of its heel end for securing the foot receiving plate to the pivoting support, and a spring connecting the toe end of the foot receiving plate to the pivoting support. The ball joint permits the foot receiving plate to pivot laterally and transversely with respect to the pivoting support, and the spring biases the foot receiving plate towards the pivoting support. Additionally, a removable ball below the toe end of the foot receiving plate allows for radial pivoting. The pivoting support is pivotably mounted via a hinge to the base beneath the toe end of the foot receiving plate, thereby permitting the foot receiving plate and pivoting support to pivot away from the base.

8 Claims, 2 Drawing Sheets

THERAPEUTIC DEVICE

TECHNICAL FIELD

This invention relates to therapeutic exercise devices. More particularly, this invention relates to therapeutic exercise devices that are particularly adapted for exercising a patient's lower extremeties. The device is particularly adaptable to exercising and rehabilitating a patient's ankle. It is theorized that use of the device, as hereinafter described, has a positive therapeutic effect on the hip.

BACKGROUND OF THE INVENTION

In order to discuss the prior art, it is necessary to discuss the terminology of foot movement. The human foot is capable of a wide range of motion provided by the ankle joint and the lower leg. The primary motion provided by the ankle joint is dorsal and plantar flexion. In plantar flexion, the foot is pivoted about the ankle joint to move the toes downward below the ankle. This is colloquially known as standing on ones toes. In dorsiflexion, the foot is pivoted about the ankle joint to draw the toes upward above the heel.

The ankle joint also permits limited motion in inversion and eversion. In inversion, the soles of both feet would move toward each other if both feet are inverted simultaneously. In eversion, the soles of the feet would move away from each other if both feet were everted simultaneously.

Finally, the foot and ankle joint may be rotated about an axis extending through the ankle joint and heel by the action of the tibia and fibula, the bones forming the lower leg.

Perhaps the best known prior art apparatus relating to the present invention is the so-called BAPS board. A BAPS board amounts to a board, or elongated surface, which is used in conjunction with a cylindrical support which is hemispherical (in cross-section). The patient places the board on the hemispherical support, the flat side of the support, sitting on the floor or ground. The board then is manipulated with the patient's foot and lower leg in a backward and forward or transverse motion. This exercise tends to strengthen the ankle as well as the calf muscles and those working in opposition thereto. Whether the patient is sitting or standing, use of the BAPS board primarily exercises just the calf and muscles in dorsal and plantar flexion. Moreover, the BAPS board is relatively unstable, potentially subjecting the patient to injury.

U.S. Pat. No. 735,319 to Urwick discloses an exercising apparatus which is an improvement on the BAPS board in that a resistance means (i.e. springs) is employed to resist forward movement of the toes or downward movement of the heel.

U.S. Pat. No. 4,279,415 to Sam Katz discloses an exercise device wherein a platform pivots about an axis adjacent the patient's heel. Cushioned resistance is provided as the foot is pressed against a resilient material between the platform and a supporting platform.

U.S. Pat. No. 4,206,558 to Vincent J. Bivona amounts to an integration of the BAPS board concept. Bivona merges the board with the support to provide a foot surface which is supported by a hyperbolic bottom surface.

U.S. Pat. No. 4,573,678 to Steve Lamb et al. discloses an adjustable footgear that is strapped to the user's foot. The footgear has a base with an angularly adjustable sole platform connected by a heel pivot to a base. The platform has a manual adjustment mechanism for raising the toe end of the platform any select degree above the heel end to dorsiflex the foot upon walking.

U.S. Pat. No. 4,759,542 to Donald P. Hudec discloses a device and method intended to correlate the reflexes of the person using the device. The device is another variation on the BAPS board.

All the aforementioned disclosures relate to lower leg or ankle exercise devices which provide exercise motion substantially in one dimension, namely, the forward and backward dimension in which one foot is flexed. In the terminology discussed above, dorsal and plantar flexion.

U.S. Pat. No. 4,739,986 (Edward J. Kucharik et al.), U.S. Pat. No. 4,452,447 (Lepley et al.), U.S. Pat. No. 4,310,155 (Wilson F. White), U.S. Pat. No. 4,635,932 (James A. Dewces), U.S. Pat. No. S. Pat. No. 4,251,068 (Edward J. Tarnacki), and U.S. Pat. No. S. Pat. No. 4,629,181 (Krieve) disclose foot or lower extremity exercisers which provide exercise resistance in two or three dimensions.

U.S. Pat. No. S. Pat. No. 4,452,447 to Chelsea Lepley et al. describes an ankle exerciser which permits isokinitic exercise of the ankle joint. The device of Lepley et al. separately, and individually, controls the resistance provided against ankle movement about each of the independently controllable, resistive axes.

U.S. Pat. No. 4,739,986 also describes an exercise apparatus which permits three-dimensional exercise of the feet, ankles and lower legs. The device of Kucharik is a spring-mounted assembly wherein the axis of the mount is substantially co-linear with the exerciser's leg.

U.S. Pat. No. S. Pat. No. 4,629,181 discloses a multidirectional movement leg exerciser comprising a base, a turntable rotatably mounted thereon, and foot supports. The device of the '181 patent provides exercise primarily about a single axis substantially colinear with the exerciser's leg.

None of the above references, disclose or suggest the multi-dimensional, easily portable, yet relatively inexpensive lower extremity exercise apparatus of this invention.

BRIEF SUMMARY OF THE INVENTION

Briefly, in one respect, the present invention is an exercise apparatus comprising a foot receiving plate or sole plate, a pivoting or pivotable support or connector, and a base. The foot receiving plate has a top and a bottom, a heel end and a toe end, and includes a foot retention means. The foot receiving plate further includes securement means adjacent and on the bottom of its heel end, the securement means securing said foot receiving plate to said pivoting support while permitting said foot receiving plate to pivot laterally and transversely with respect to said pivoting support. The foot receiving plate further includes biasing means, the biasing means being connected to said pivoting support so as to bias the toe end of said foot receiving plate toward said pivoting support. The pivoting support is mounted to the base beneath the toe end of said foot receiving plate so as to permit said foot receiving plate and said pivoting support to be pivoted away from said base.

In a preferred practice of the invention, the securement means described above is a ball joint which permits transverse, lateral, and rotational movement of the foot receiving plate. In a further preferred practice of this invention, the biasing means comprises a spring attached to a tension cord.

DETAILED DESCRIPTION OF THE INVENTION

Figure 1:
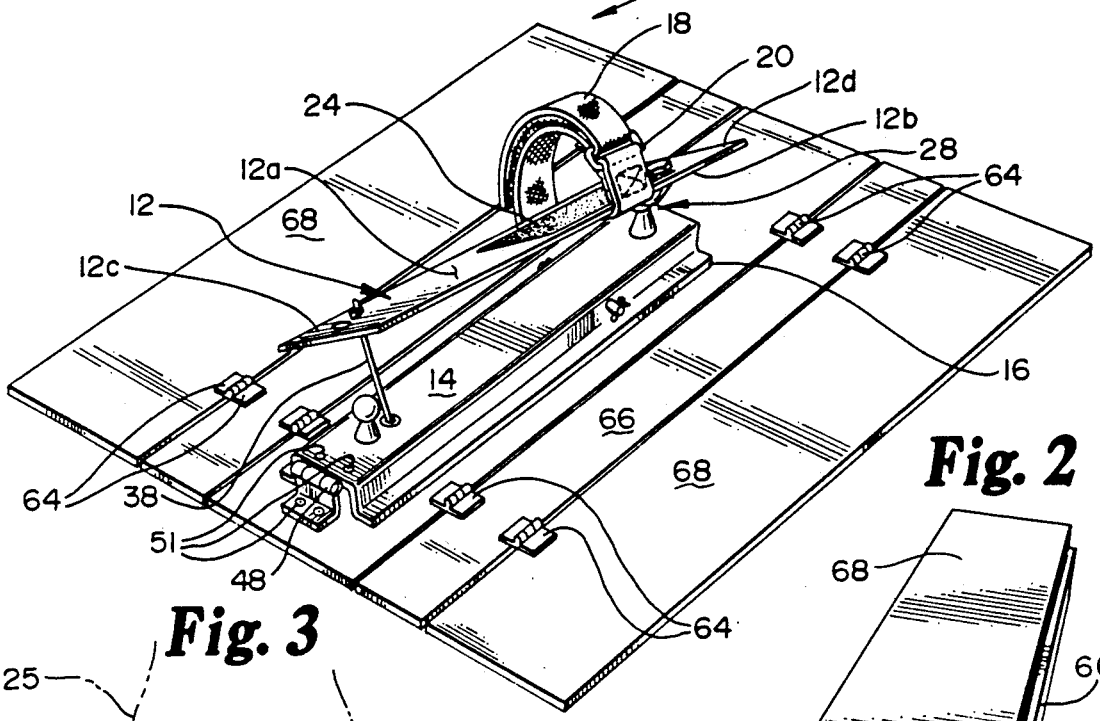
FIG. 1 is a perspective view of the apparatus in a protective carrier opened and lying flat on a horizontal surface.

Reference is now made to FIGS. 1–6 wherein like numerals are used to refer to like features therein. FIG. 1 is a perspective view of an apparatus of the present invention after it has been opened and is lying flat on a horizontal surface. Specifically, exercise apparatus 10 comprises a foot receiving plate or sole plate 12, a pivoting support 14, and a base 16. Foot receiving plate 12 has a top 12A, a bottom 12B, a toe end 12C and a heel end 12D. Foot receiving plate 12 also has a foot retention means which, in this embodiment of the invention, comprises a strap or web 18. (Multiple foot retention means are within the contemplation of this invention.) Strap 18 is connected on one end 19 to a rectangular ring or buckle 20. Strap 18 then passes entirely around foot receiving plate 12, over the top of an exerciser's foot 21 (shown in FIG. 3) and back through rectangular ring 20 to fold back upon itself. Near the end of strap 18 and upon a cooperating intermediary portion thereof is hook and pile material such as that sold under the trademark VELCRO fastener means 22. In this application, then, the foot 21 is placed upon the foot receiving means and strap 18 is wrapped therearound passing through rectangular ring 20. Strap 18 is then tightened around the top side of the foot and the VELCRO fastener 22 employed to retain the bottom of the foot 21 tightly in contact with the top 12A of receiving plate 12. Also on receiving plate 12 is an optional textured applique 24. Applique 24 provides additional friction between the foot and the top of the receiving plate so as to prevent the development of calluses and other skin irritation thereon. Strap 18 is positioned on foot receiving plate 12 so that it passes roughly over the instep or bridge 23 of the foot when in place. Once secured, movement of the foot 21 about the ankle 25 will, of necessity, be followed by foot receiving plate 12. The details of the securement means are most clearly shown in FIGS. 3 and 4.

Figure 3:
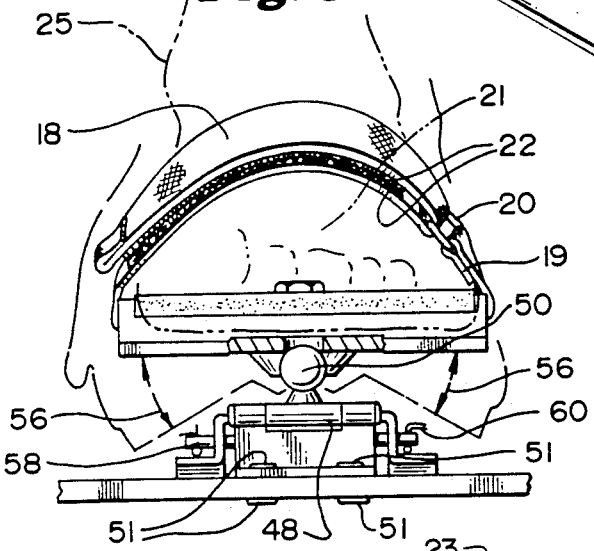
FIG. 3 is a front elevational view of an apparatus of this invention with parts cut away.
Figure 4:
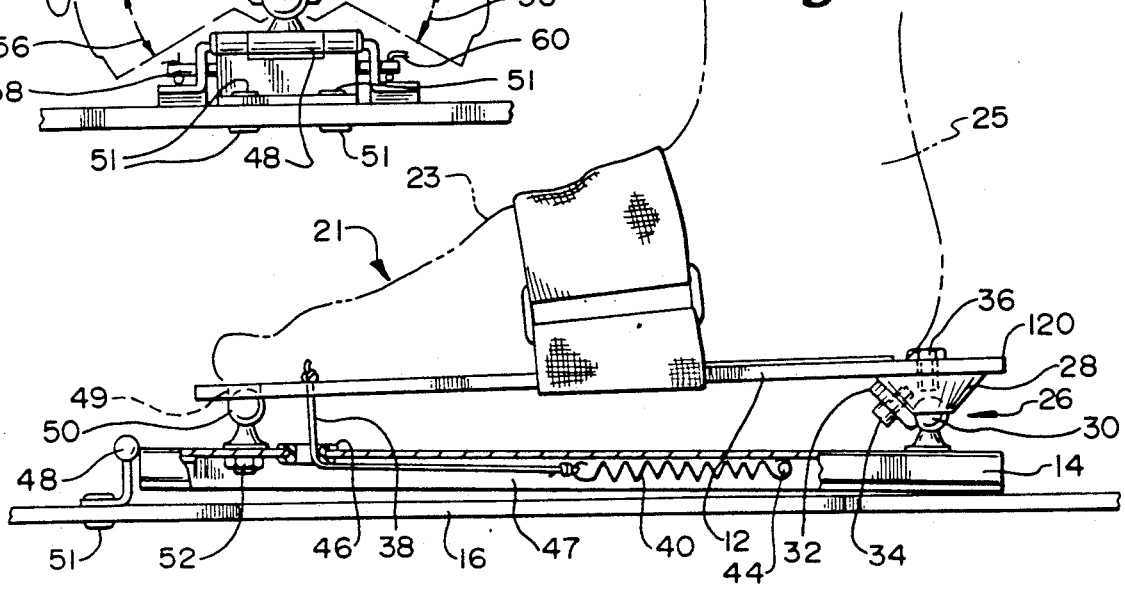
FIG. 4 is a left side elevational view with parts cut away.
Figure 5:
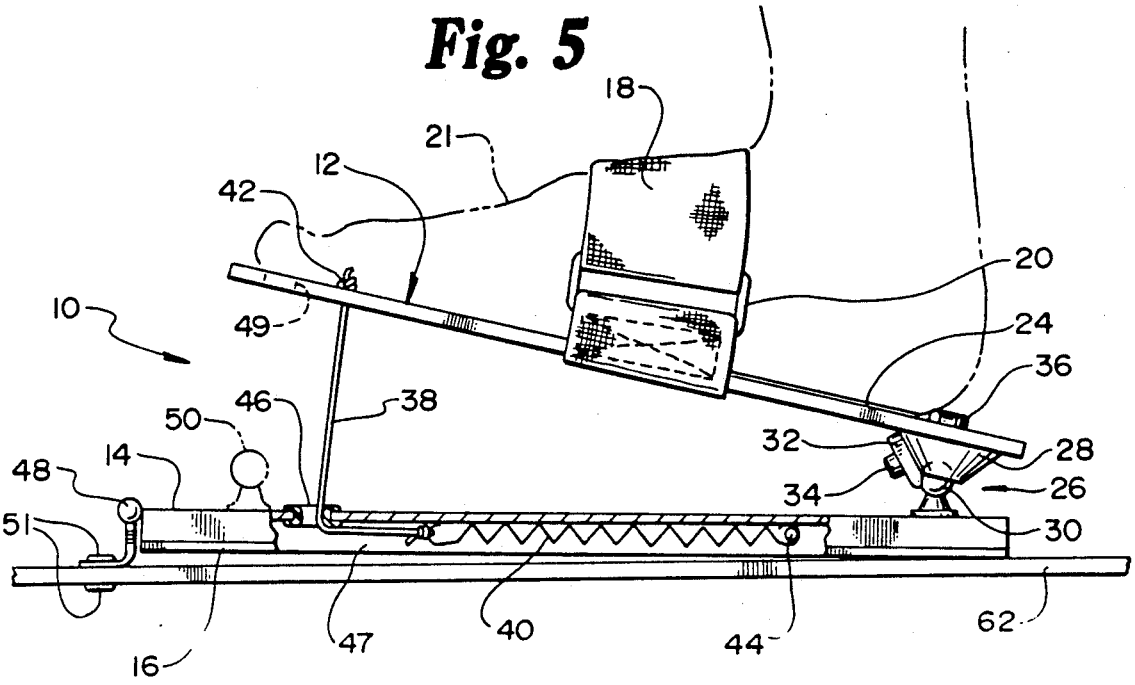
FIG. 5 is a view similar to that of FIG. 4 with parts shown in secondary position.

With reference to FIGS. 3 and 4, foot receiving plate 12 further includes a securement means which, in this embodiment, comprises a ball joint 26. Ball joint 26 is located on the underside 12B of foot receiving plate 12 adjacent the heel end 12D thereof. Ball joint 26 comprises a socket 28 and a stationary ball 30. The ball joint 26 further comprises a circular keeper 32 held in place by means of a large head screw 34. Socket 28 is held in place on the bottom 12B of receiving plate 12 by means of a hexagonal head bolt 36 which passes through foot receiving plate 12 adjacent its heel end 12D. The ball joint 26 permits foot receiving plate 12 to rotate or pivot with respect to pivoting support 14 in dorsal and plantar flexion (i.e. transversely), inversion or eversion (radially) or rotationally about an axis through the ankle joint and heel (laterally). In another sense, the combination of ball joint 26 attached beneath the heel end 12B of foot receiving plate 12 permits the foot, once strapped in place by means of foot retention means 18, to move freely in all three dimensions if the toe end 12C of foot receiving plate 12 is not secured. This embodiment of the invention is described below.

Foot receiving plate 12 further includes biasing means which, in this embodiment, comprises a cord 38 attached to a spring 40. As is most clearly shown in FIG. 4, cord 38 passes through pivoting support 14 (via ferruled hole 46) and through foot receiving plate 12 adjacent its toe end 12C. Cord 38 is then attached to the top side 12A of foot receiving plate 12 by means of an oversized (with respect to the hole through which cord 38 passes) knot 42. Spring 40 is attached to the underside of pivoting support 14 by means of a pin 44. Thus, with pressure applied at the heel, dorsiflexion stretches spring 40 pulling cord 38 through ferruled eye or hole 46 in pivoting support 14 thereby exercising the muscles about the ankle and on the front of the lower portion of the leg. As shown in FIG. 3, pivoting support 14 is "U" shaped in cross-section. Use of this preferred shaped provides a channel 47 through which the biasing means 38, 40 can be connected. Various other ways of connecting and deploying the biasing means to the foot receiving plate and pivoting support are within the contemplation of the invention.

As noted above, pivoting support 14 is connected to receiving plate 12 via ball joint 26 and cord 38. Pivoting support 14 is, itself, connected to base 16 by means of hinge 48 which is beneath the toe end 12C of foot receiving plate 12. Hinge 48 permits pivoting support 14 to rotate with respect to base 16. Hinge 48 permits pivoting support 14 only 2° of rotational latitude (i.e., about two axes). Hinge 48 is attached to base 16 and pivoting support 14 by means of a series of screws 51 beneath the toe end of foot receiving plate 12.

Also attached to pivoting support 14 is an optional detachable or removable ball 50. The removable ball 50 is attached to pivoting support 14 by means of a hexagonal nut 52. Ball 50 cooperates with indentation or beveled hole 49 on the underside 12B adjacent the toe end 12C of foot receiving plate 12 to permit pivoting support 14 to rotate laterally. This movement is most clearly shown by the arrows 56 in FIG. 3. Arrows 56 depict foot movement which has previously been referred to as eversion or inversion.

Optional removable ball 50 (or its equivalent) provides space between foot receiving plate 12 and pivoting support 14, as is shown in FIG. 4. The present invention would also be operable if ball 50 were omitted. In that circumstance, toe end 12C of foot receiving plate 12 would be in direct contact with pivoting support 14

FIGS. 3, 4, 5 and 6 show four possible movements which are permissable in a practice the present invention. In FIG. 3, the foot 21 is placed flat upon foot receiving plate 12 in contact with pivoting support 14 and both its heel 12D and toe end 12C. In that configuration, as shown in, FIGS. 3–4 with the optional removable ball 50, permits an inversion or eversion exercise motion. If removable ball 50 is not employed (i.e., it is removed), then foot receiving plate 12 is capable of rotation about an axis extending through the ankle around ball joint 26. Biasing means 38, 40 would permit the muscles which cause the inversion or eversion motion to be strengthened.

Figure 6:
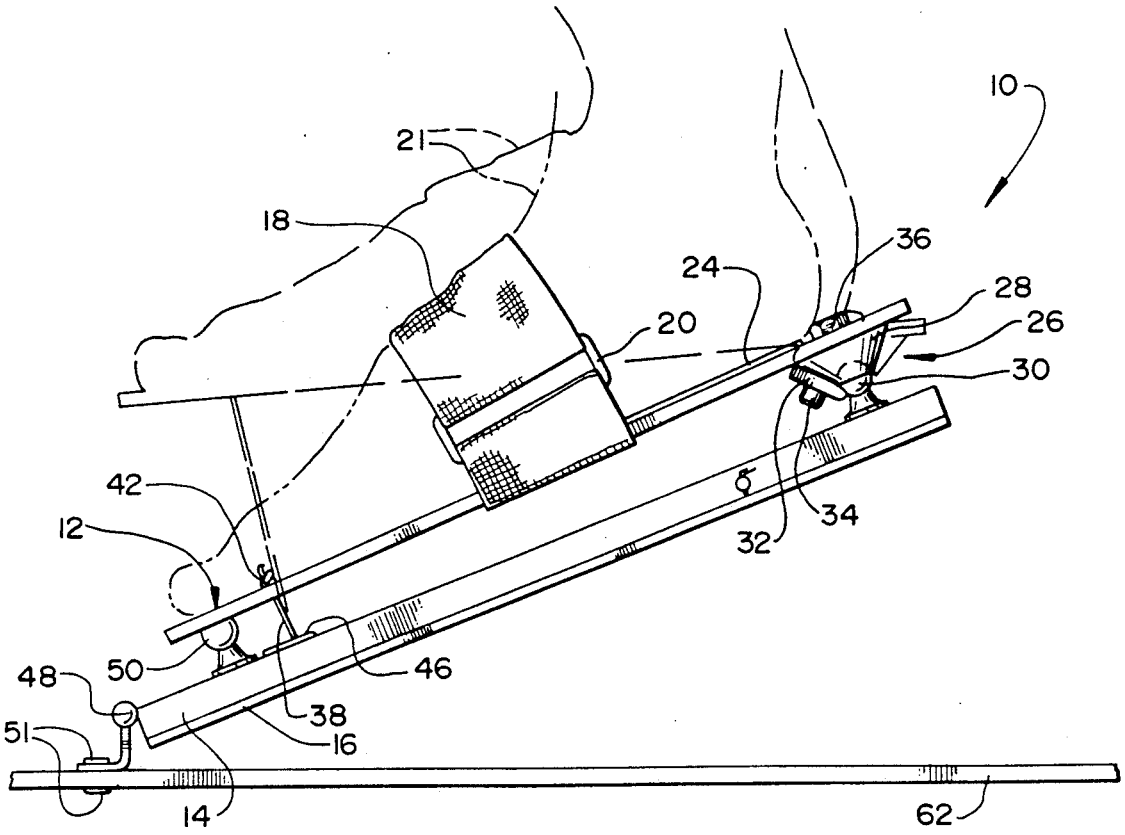
FIG. 6 is a left-side elevational view with parts shown in tertiary and quaternary position.

In a second mode of operation, namely dorsiflexion, the foot is pivoted about the ankle, the toes being drawn above the heel. FIG. 6 then shows the opposite of dorsiflexion (namely, plantar flexion) in which the person exercises pivoting the foot about the ankle to move the toes downward. Lastly, as shown in FIG. 6, if foot receiving plate 12 is not attached or anchored to pivoting support 14, then foot plate 12 may be rotated (in a dorsiflexion motion) away from pivoting support 14 providing a fourth degree of freedom is made of deployment. In each and every one of the modes, movement about three mutually perpendicular axes is permitted. As is shown in FIG. 6, movement of the upper leg also is contemplated in order to swing the foot receiving plate 12 and pivoting support away from base 16.

In an optional embodiment, pivoting support 14 may be affixed to base 16 so that they remain substantially parallel during the exercise procedure. This is accomplished by an optional fixation means which, in this embodiment, is a cotter key 58 which passes through pivoting support 14 and is maintained in place by one or more pins 60. Pins 60 may be removed, the cotter key 58 withdrawn, thereby permitting pivoting support 14 to rotate with respect to base 16 about hinge 48.

Figure 2:
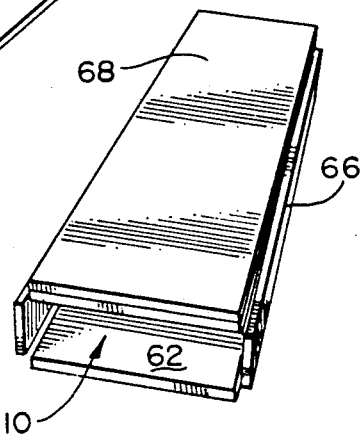
FIG. 2 is a perspective view of the apparatus of FIG. 1 folded into a rectangular box form.

FIG. 2 depicts a preferred technique for packaging and carrying the present invention. FIG. 2 shows a folded exercise apparatus 10 with the base 16 being mounted upon the bottom 62 of a rectilinear container which employs hinges 64 attached to laterally disposed rectangular fillers 66 and, in turn, to wings 68 to contain and enclose the present invention. In its folded configuration, shown in FIG. 2, the device is compact and easily storable.

A particularly important feature of the present invention is the fact that it provides a fulcrum (i.e., ball joint 26) at the heel end 12D of plate 12. With this feature, the tension and therefore the exercise difficulty can be varied. The tension is varied by the amount of weight the exercising person places upon the heel portion of the foot receiving plate 12. For example, by stepping forward with the non-exercising foot, more stress is placed upon the heel thereby increasing the exercise output of the muscles of the lower leg.

Numerous characteristics and advantages of the invention have been set forth in the foregoing description. It will be understood, of course, that this disclosure is, in many respects, only illustrative. Changes can be made in details, particularly in matters of shape, size, and arrangement of parts without exceeding the scope of the invention. The invention's scope is defined in the language in which the appended claims are expressed.

What is claimed is as follows:

1. An exercise apparatus comprising a foot receiving plate, a pivoting support, substantially conforming to the shape of the foot receiving plate and a base;

said foot receiving plate having a top and a bottom, a heel end and a toe end, and a foot retention means, said foot receiving plate including securement means adjacent and on the bottom of its heel end, said securement means securing said foot receiving plate to said pivoting support while permitting said foot receiving plate to pivot laterally and transversely with respect to said pivoting support, said foot receiving plate further including biasing means, said biasing means being connected to said pivoting support, so as to bias the toe end of said foot receiving plate toward said pivoting support;

said pivoting support being pivotably mounted to said base beneath the toe end of said foot receiving plate so as to permit said foot receiving plate and said pivoting support to be pivoted away from said base.

2. An exercise apparatus according to claim 1 wherein said base includes spacer means and foldable wings, said spacer means being hingeably attached to said wings whereby said wings, when folded, enclose said apparatus;

3. An exercise apparatus according to claim 1 wherein said pivoting support includes an upwardly projecting spacer located on the end opposite where said pivoting support is secured to said foot receiving plate, the upwardly projecting spacer in conjunction with said heel-disposed pivoting means permitting said foot receiving plate to pivot radially with respect to said pivoting support.

4. An exercise apparatus according to claim 3 wherein said upwardly projecting spacer is a removable ball.

5. An exercise apparatus according to claim 1 wherein said securement means is a ball joint.

6. An exercise apparatus according to claim 1 wherein said biasing means comprises a spring connected to the underside of said pivoting support said spring being connected to cord means which passes through said pivoting support and is secured to the top of said foot receiving plate.

7. An exercise apparatus according to claim 1 wherein said foot retention means comprises a strap.

8. An exercise apparatus according to claim 7 wherein said strap comprises a hook and pile material fastener.

* * * * *